US007952526B2

(12) United States Patent
Lee et al.

(10) Patent No.: US 7,952,526 B2
(45) Date of Patent: May 31, 2011

(54) COMPACT DUAL-BAND RESONATOR USING ANISOTROPIC METAMATERIAL

(75) Inventors: Cheng-Jung Lee, Los Angeles, CA (US); Kevin M. K. H. Leong, Los Angeles, CA (US); Tatsuo Itoh, Rolling Hills, CA (US)

(73) Assignee: The Regents of the University of California, Oakland, CA (US)

( * ) Notice: Subject to any disclaimer, the term of this patent is extended or adjusted under 35 U.S.C. 154(b) by 936 days.

(21) Appl. No.: 11/844,249

(22) Filed: Aug. 23, 2007

(65) Prior Publication Data

US 2008/0204327 A1 Aug. 28, 2008

Related U.S. Application Data

(60) Provisional application No. 60/841,668, filed on Aug. 30, 2006.

(51) Int. Cl.
*H01Q 1/38* (2006.01)
*H01Q 15/02* (2006.01)

(52) U.S. Cl. ..... 343/700 MS; 343/909

(58) Field of Classification Search ..... 343/700 MS, 343/702, 754, 749, 846, 909
See application file for complete search history.

(56) References Cited

U.S. PATENT DOCUMENTS

| | | | | |
|---|---|---|---|---|
| 6,567,048 | B2 | 5/2003 | McKinzie, III et al. | |
| 7,764,232 | B2 * | 7/2010 | Achour et al. | 343/700 MS |
| 2003/0137457 | A1 | 7/2003 | McKinzie, III et al. | |
| 2005/0225492 | A1 | 10/2005 | Metz | |

OTHER PUBLICATIONS

Z. Jaksic et al. Negative refractive index metamaterials: principles and applications. Mikrotalasna revija, Jun. 2006, pp. 36-49.

C-J. Lee et al. Composite right/left-handed transmission line based compact resonant antennas for RF module integration. IEEE Transactions on Antennas and Propagation, vol. 54, No. 8, pp. 2283-2291 (2006).

A. Lai et al. Dual-mode compact microstrip antenna based on fundamental backward wave. Microwave Conference Proceedings, 2005. APMC 2005. Asia-Pacific Conference Proceedings, Dec. 2005, vol. 4, pp. 4-7.

T. Ueda et al. Dielectric Resonator-Based Left-Handed Metamaterials: Guided Wave. Poster, presented 2007, available at <http://www.mwlab.ee.ucla.edu/poster/2007/Guided_Wave30×40.pdf>.

* cited by examiner

*Primary Examiner* — Shih-Chao Chen
(74) *Attorney, Agent, or Firm* — John P. O'Banion

(57) ABSTRACT

A dual-band resonator with compact size, such as a resonant type dual-band antenna, which uses an anisotropic metamaterial is described. The artificial anisotropic medium is implemented by employing a composite right/left-handed transmission line. The dispersion relation and the antenna physical size only depend on the composition of the unit cell and the number of cells used. By engineering the characteristics of the unit cells to be different in two orthogonal directions, the corresponding propagation constants can be controlled, thus enabling dual-band antenna resonances. In addition, the antenna dimensions can be markedly minimized by maximally reducing the unit cell size. A dual-band antenna is also described which is designed for operation at frequencies for PCS/Bluetooth applications, and which has a physical size of $\frac{1}{18}\lambda_0 \times \frac{1}{18}\lambda_0 \times \frac{1}{19}\lambda_0$, where $\lambda_0$ is the free space wavelength at 2.37 GHz.

43 Claims, 10 Drawing Sheets

COMPACT DUAL-BAND RESONATOR USING ANISOTROPIC METAMATERIAL

CROSS-REFERENCE TO RELATED APPLICATIONS

This application claims priority from U.S. provisional application Ser. No. 60/841,668 filed on Aug. 30, 2006, incorporated herein by reference in its entirety.

STATEMENT REGARDING FEDERALLY SPONSORED RESEARCH OR DEVELOPMENT

This invention was made with Government support under Grant No. N00014-01-1-0803 awarded by the U.S. Navy/Office of Naval Research. The Government has certain rights in this invention.

INCORPORATION-BY-REFERENCE OF MATERIAL SUBMITTED ON A COMPACT DISC

Not Applicable

BACKGROUND OF THE INVENTION

1. Field of the Invention

This invention pertains generally to dual-band resonant devices, and more particularly to compact dual-band resonant devices formed from anisotropic metamaterial.

2. Description of Related Art

Wireless communication capability has become a built-in function in almost all modern hi-tech products in the past few years. In particular, dual-band or multi-band operations such as GPS/K-PCS and PCS/IMT-2000/Bluetooth, which are able to provide multiple functions within a single device, are receiving increasing attention. In the radio-frequency (RF) front-end module of such wireless multi-band systems, the antennas which can support multi-band transmitting and receiving are one of the critical elements needed to construct. Generally, multi-band operation is achieved by creating various configurations to resonate at different frequencies required for a specific application in a single radiating device. For example, a dual-band antenna has been realized by slightly changing the shape of a rectangular patch antenna and exciting two frequency modes with two feeding lines. A planar inverted f-antenna (PIFA) is another popular antenna that can achieve multi-band operation.

In addition, due to the decreasing available space for the wireless module, shrinking the antenna size is another important issue considered in the design specification. One approach to reducing antenna size, is to use metamaterials in the design and construction of the antennal. As we have previously demonstrated, because of their unique electromagnetic properties metamaterials can be applied to antenna applications where the size of the antenna need to be substantially reduced (C. J. Lee, K. M. K. H. Leong, and T. Itoh, "Design of resonant small antenna using composite right/left-handed transmission line," *Antenna and Propagation Society Symposium*, July 2005).

BRIEF SUMMARY OF THE INVENTION

Accordingly, an aspect of the present invention is a dual-band resonant structure that is fabricated from anisotropic metamaterials and configured for use in realizing compact antennas and devices.

Another aspect of the invention is the realization of a miniature dual-band antenna in which the radiation frequency depends on the configuration of the unit cell rather than on the antenna's physical size. Therefore, a small antenna can be easily achieved by using a small unit cell as its composition.

Another aspect of the invention is realization of dual-band operation by using an anisotropic metamaterial with different propagation constants ($\beta$'s) in orthogonal propagation directions of the metamaterial. For example, in stark contrast to a conventional patch antenna which uses different physical lengths but the same $\beta$ to create dual-band operation, the present invention uses the same physical length but different $\beta$'s to achieve dual-band operation. In one embodiment, the $n=-1$ mode is chosen in both resonant directions to provide better impedance matching and higher radiation efficiency as well as realizing a compact antenna size.

By way of example, and not of limitation, dual-band antenna embodiments of the present invention are constructed with anisotropic metamaterials where the individual constituent periodic structures implement composite right/left handed transmission lines (CRLH-TL's). The mode of operation is a left-handed (LH) mode, so its propagation constant approaches negative infinity as the frequency decreases to the lower cutoff frequency. Therefore, an electrically large, but physically small, antenna can be fabricated to fit within everyday portable wireless devices.

In one embodiment, a dual-band anisotropic metamaterial resonant apparatus comprises a plurality of spaced-apart microstrip CRLH unit cells arranged in an array that has first and second orthogonal directions; at least two of said unit cells cascaded in the first direction; and at least two of said unit cells cascaded in the second direction; said array having different $\beta$'s in orthogonal propagation directions to achieve dual-band resonance.

In another embodiment, an anisotropic metamaterial dual-band resonant apparatus comprises a first dielectric substrate layer having a surface; a metallized backplane layer; a second dielectric substrate layer between said first substrate layer and said backplane layer; a plurality of spaced-apart microstrip CRLH unit cells formed of metallized patches arranged in an array on the surface of said first substrate layer, each said patch having an electrical connection to said backplane layer through said second substrate layer; said array having first and second orthogonal directions; at least two of said unit cells cascaded in the first direction; at least two of said unit cells cascaded in the second direction; said array having different $\beta$'s in orthogonal propagation directions to achieve dual-band resonance.

In a still further embodiment, a dual-band anisotropic metamaterial resonant apparatus comprises a 2×2 array of spaced-apart microstrip unit cells; said array having first and second orthogonal propagation directions; and said array having different $\beta$'s in said orthogonal propagation directions to achieve dual-band resonance.

In another embodiment, a micro-miniature dual-band resonant device comprises an anisotropic metamaterial having at least two-dimensions in an x-y plane; a pair of composite right/left handed transmission lines (CRLH-TL's) implemented within the same spaces of the anisotropic metamaterial but with different frequency responses in different directions within the anisotropic metamaterial; and a feed to the CRLH-TL's providing for a first frequency of operation and a second frequency of operation with respective ones of CRLH-TL's in said dual-band resonant device.

In another embodiment, a method of micro-miniaturization of a dual-band resonant device comprises micro-miniaturizing said device by implementing it with composite right/ left handed transmission lines (CRLH-TL's) each having different frequency responses; and imparting a multi-band functionality to said device by implementing a plurality of said CRLH-TL's to lie in different directions within an anisotropic metamaterial.

In another embodiment, a portable wireless device comprises a micro-miniature dual-band antenna for simultaneous operation at different first and second frequencies; a first frequency wireless transmitter or receiver coupled to the antenna for interoperation with a first-frequency wireless service; and a second frequency wireless transmitter or receiver coupled to the antenna for interoperation with a second-frequency wireless service; wherein all such components are completely disposed within a single said portable wireless device.

In still another embodiment, a portable wireless device comprises a micro-miniature dual-band antenna for simultaneous operation at different first and second frequencies; a first frequency wireless transmitter or receiver coupled to the antenna for interoperation with a first-frequency wireless service; and a second frequency wireless transmitter or receiver coupled to the antenna for interoperation with a second-frequency wireless service; wherein said antenna further comprises an anisotropic metamaterial having two-dimensions in the x- and y-directions, a pair of composite right/left handed transmission lines (CRLH-TL's) implemented within the same spaces of the anisotropic metamaterial but with different frequency responses in the x- and y-directions of the anisotropic metamaterial, a first feedline coupled to one of the CRLH-TL's in said x-direction providing for a first frequency of operation, and a second feedline to the other one of the CRLH-TL's in said y-direction providing for a second frequency of operation in said dual-band antenna, wherein said first and second feedlines are separate feedlines or are the same feedlines, an array of individual constituent periodic structures disposed in the anisotropic metamaterial that together implement the CRLH-TL's, a unit cell structure having a metal plate with a via connecting said metal plate at its center to an underlying backplane, and disposed within each of the individual constituent periodic structures, and having an equivalent circuit in which a T-bandpass circuit includes a shunt L-C circuit implemented by said via stem connection and underlying backplane, and series L-C circuits across each x- and y-direction implemented by said square metal plates and gaps between them, and a metal-insulator-metal (MIM) capacitor disposed between adjacent ones of the unit cell structures in one of the x- and y-directions only, wherein such directional asymmetry imparts correspondingly different frequency responses to each of the pair of CRLH-TL's; wherein all such components are completely disposed within a single said portable wireless device.

In one embodiment, each of the individual constituent periodic structures are asymmetric in their x- and y-axes, with one axis providing resonance at one frequency and the other axis providing resonance at the second frequency. In one embodiment, the individual constituent periodic structures are arrayed in a square matrix, and the array is provided with an offset feed for the dual-bands being used. In one embodiment, metal-insulator-metal (MIM) capacitors are used to couple mushroom-like metal structures with a square top and a central via stem, but only in one axis. In the other axis, there are no MIM capacitors coupling the mushroom-like metal structures together along the CRLH-TL.

Further aspects and embodiments of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Metamaterials can be constructed to have unique electromagnetic properties that can be used to great advantage in making micro-miniature antennas. The resonant frequencies of these antennas will be dependent on the metamaterial unit cell construction, not just the antenna's physical dimensions. The metamaterial unit cell construction can be made so as to shorten the physical space needed to accommodate a half-wavelength, quarter-wavelength, etc. Thus, a micro-miniaturized antenna can be achieved by equally small unit cells in the metamaterial composition.

Dual-band operation is implemented by using an anisotropic metamaterial with different $\beta$'s in orthogonal propagation directions of the metamaterial. In other words, a physically square-shaped antenna can be made to look electrically like it has different wavelengths in its two dimensions. This is unlike a conventional patch antenna made of homogeneous material which works the two different physical dimensions in a rectangular shape, e.g., the material has the same β in any direction.

Figure 1:
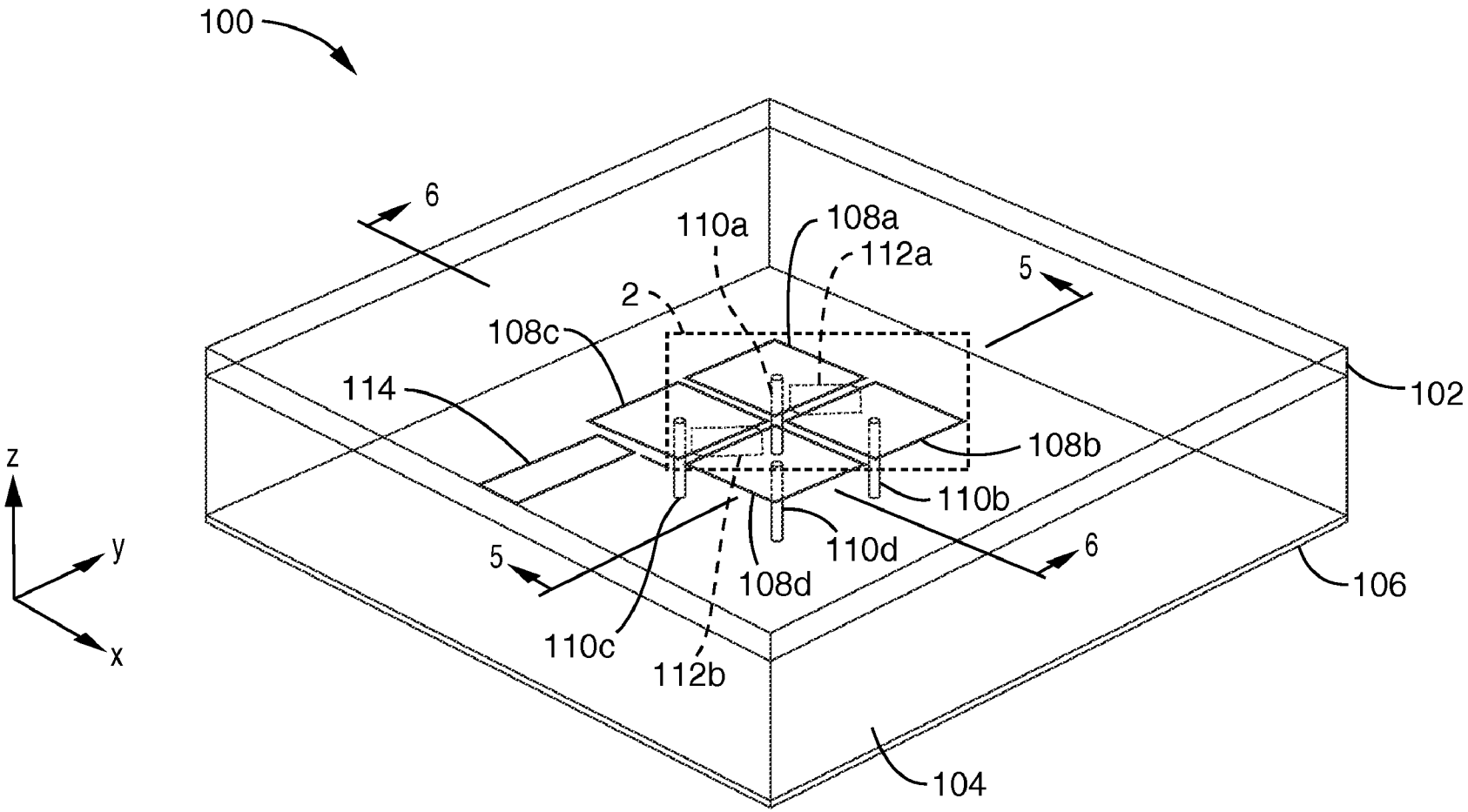
FIG. 1 is a schematic perspective view of an embodiment of a dual-band resonator structure according to the present invention.

An embodiment of a compact dual-band resonator according to the present invention is shown in FIG. 1, and is referred to herein by the general reference numeral 100. In the embodiment shown, the device comprises a multi-layer structure having a first (upper) substrate layer 102, a second (lower) substrate layer 104, and a metallized ground plane layer 106. In this embodiment, four spaced-apart metallized patches 108*a-d* are arranged on the upper surface of the first substrate layer 102 in a 2×2 array. The patches 108*a-d* are connected to the ground plane 106 using metallic vias 110*a-d*, respectively, which pass through the second substrate layer 104.

Figure 2:
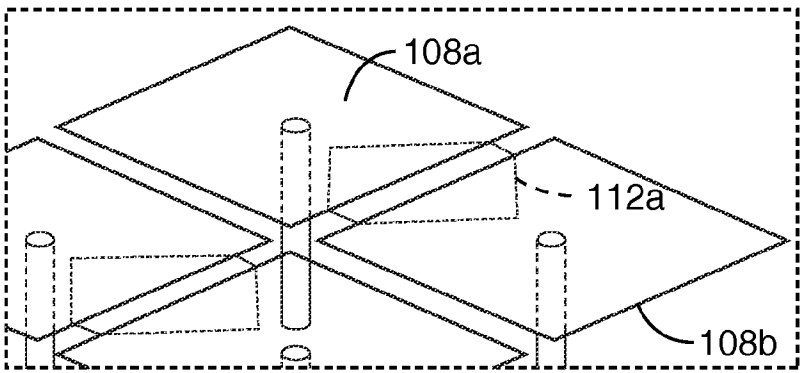
FIG. 2 is a detail view of a portion of the structure shown in FIG. 1, illustrating the positioning of MIM capacitors.

A pair of metallized patches 112*a*, 112*b* is positioned beneath patches 108*a-d* between first substrate layer 102 and second substrate layer 104. As also illustrated in FIG. 2, each patch 112 straddles a corresponding pair of patches 108 along the x-axis depicted in FIG. 1, to form metal-insulator-metal (MIM) type capacitors. Note that In the embodiment shown, patches 112*a*, 112*b* are generally square-shaped patches which are rotated approximately forty-five degrees in relation to patches 108*a-b*, 108*c-d*, respectively, to provide clearance for vias 110*a-d*, but such rotation is not mandatory. Note also that patches 112*a*, 112*b* do not form MIM capacitors along the y-axis in this embodiment, the reason for which is described below. Further, note that the corners of patches 112*a*, 112*b* in the y-direction are cut off as illustrated in FIG. 2 in this embodiment.

Figure 3:
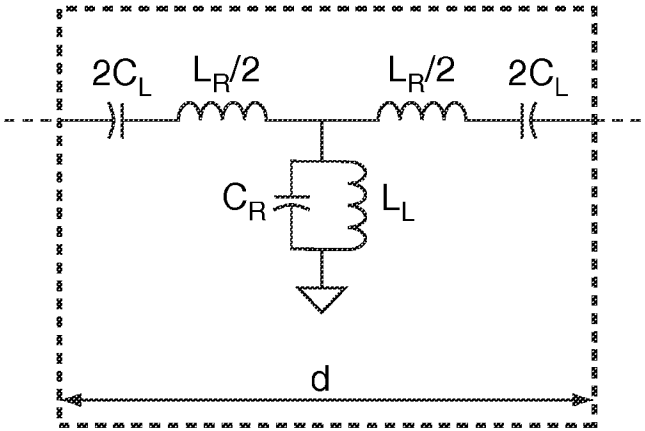
FIG. 3 is a schematic diagram of the equivalent circuit of the CRLH-TL unit cell corresponding to FIG. 1.

From the foregoing it can be seen that resonator comprises a composite right/left-handed transmission line (CRLH-TL) with two CRLH unit cells cascaded in both x- and y-directions. FIG. 3 shows the equivalent circuit model of the CRLH-TL which consists of series capacitance ($C_L$), inductance ($L_R$), shunt capacitance ($C_R$) and inductance ($L_L$). By using the transmission line implementation of the metamaterial (see, C. Caloz, and T. Itoh, "Application of the transmission line theory of left-handed (LH) materials to the realization of a microstrip "LH line"," *IEEE Antennas and Propagation Society Symposium*, vol. 2, pp. 412-415, June 2002; see also, C. Caloz and T. Itoh. "Novel microwave devices and structures based on the transmission line approach of meta-materials," *IEEE International Microwave Symposium*, vol. 1, pp. 195-198, June 2003), the resonator can be designed to operate in the left-handed mode where the β approaches negative infinity (wavelength becomes infinite small) as the frequency decreases to the lower cutoff. Therefore, the physical size of the half-wavelength resonator, such as an antenna, can be extremely reduced while the field distribution along the resonant direction remains the same.

Each patch 108 and its corresponding via 110 forms a unit cell in the matrix. The coupling capacitance between adjacent unit cells acts like $C_L$ and the metallic via which forms a shorting pin connected to the ground plane acts like $L_L$. The microstrip patch possesses the right-handed parasitic effect which can be seen as $L_R$ and $C_R$. In addition, since the dispersion characteristic is determined by the unit cell of the CRLH-TL, the anisotropic metamaterial can be easily implemented by designing the unit cells differently in the x and y directions, as shown in FIG. 1. In the x- and y-directions, the $C_L$ is realized by the gap coupling between the top patches. However, in the x-direction, the additional metal-insulator-metal (MIM) capacitance enhances the series capacitance, thus increasing the coupling between the adjacent unit cells.

Figure 4:
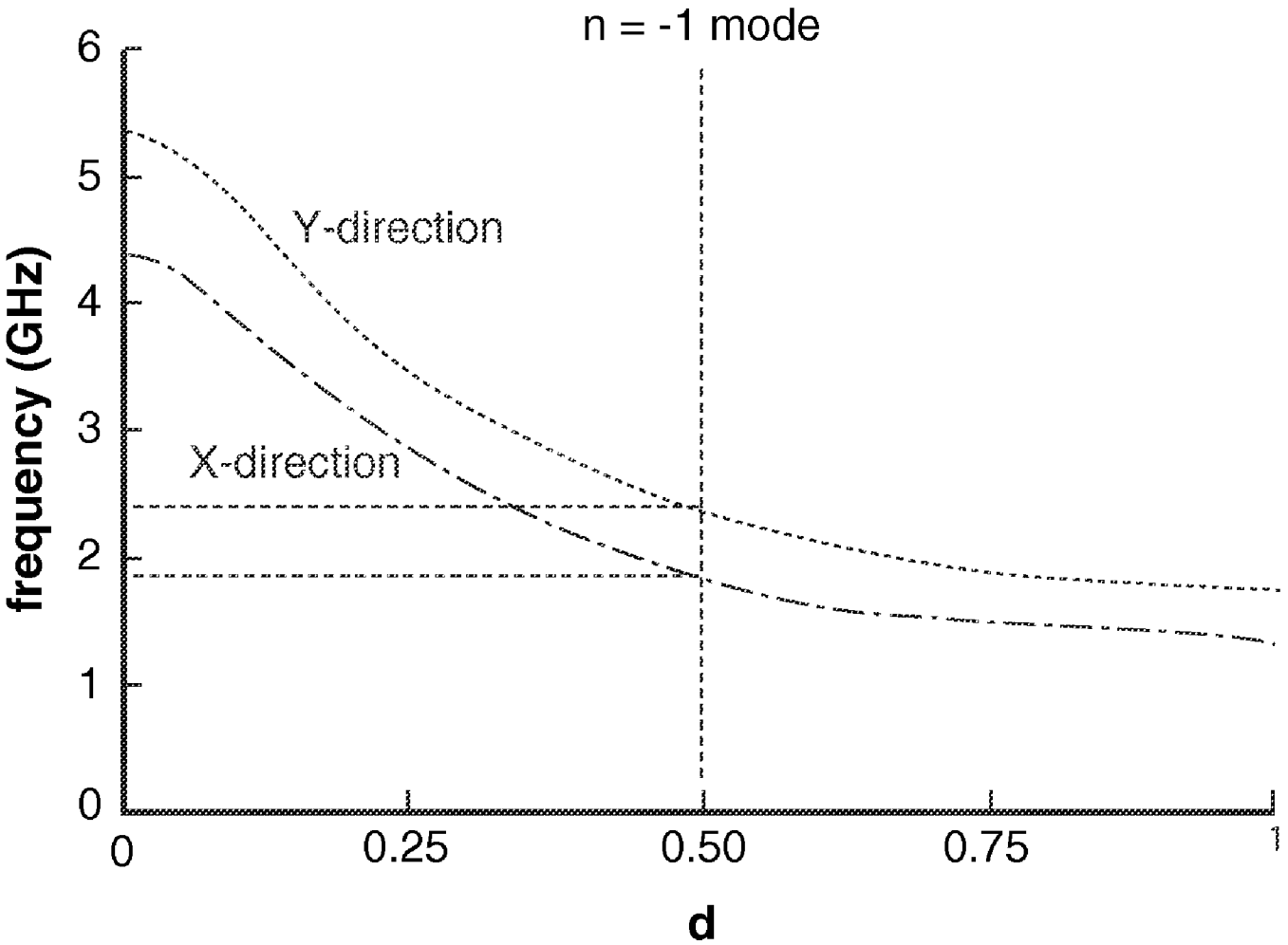
FIG. 4 is a graph showing two dispersion curves corresponding to the x- and y-directions, and are based on equivalent circuit parameters that were extracted from a full-wave simulation.

FIG. 4 shows exemplary dispersion diagrams corresponding to the x- and y-directions, which are based on the equivalent circuit parameters extracted from a full-wave simulation described more fully below. Since larger capacitance is arranged in the x-direction, the dispersion curve along the x-direction will appear at a lower frequency than the dispersion curve along the y-direction which has no $C_L$ contribution from the MIM capacitance. Dual-band operation can be consequently developed by exciting the device at different β's in the different directions even when the physical dimensions in the two directions are identical. The n=−1 mode, which implies βd/π=0.5, is chosen to provide half-wavelength field distribution and better impedance matching.

Figure 6:
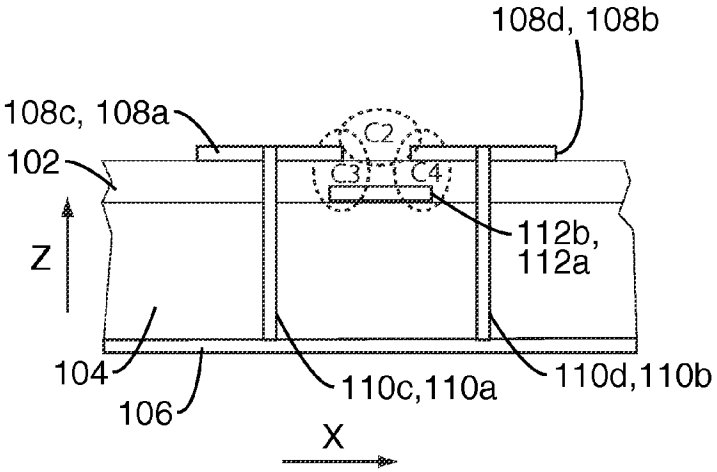
FIG. 6 is a cross-sectional diagrams of FIG. 1 taken through line 6-6.
Figure 5:
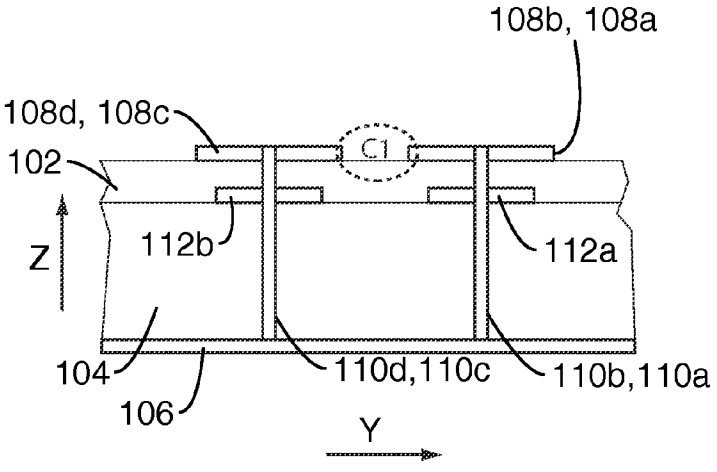
FIG. 5 is a cross-sectional diagrams of FIG. 1 taken through line 5-5.
Figure 8:
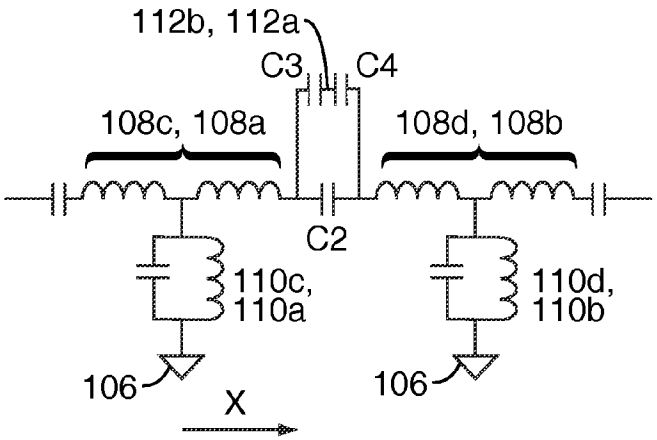
FIG. 8 is schematic diagram of the equivalent circuit of the CRLH-TL corresponding to FIG. 6.
Figure 7:
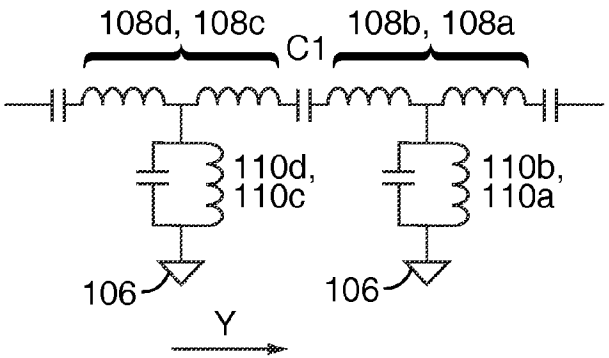
FIG. 7 is schematic diagram of the equivalent circuit of the CRLH-TL corresponding to FIG. 5.

Referring more particularly to FIG. 5, the y-direction coupling between adjacent edges of patches 108*a*, 108*b* and 108*c*, 108*d* forms one capacitor (C1) between them along the y-axis. Referring also to FIG. 6, in the orthogonal direction the x-axis coupling between adjacent edges of patches 108*a*, 108*c* and 108*b*, 108*d* form one capacitor (C2) between them along the x-axis. As shown in FIG. 6, the two metallized patches 112*a*, 112*b* form one electrode each of two MIM capacitors (C3 and C4), and are overhung by portions of patches 108*a*, 108*b* and 108*c*, 108*d*, respectively. The overhanging portions form the opposite plates of MIM capacitors C3 and C4, the series combination of which is in parallel with capacitor C2.

Referring again to FIG. 1, a microstrip feedline 114 is placed off-center and on one side of the 2×2 array. The offset feed, as opposed to a center feed, is used so that the array can be excited at different β's in the different directions, even when the physical dimensions in the two directions are identical. As indicated previously, the n=−1 mode, which implies βd/π=0.5, was chosen to provide half-wavelength field distribution, better impedance matching, higher radiation efficiency, and a very compact antenna size.

Example

Figure 9:
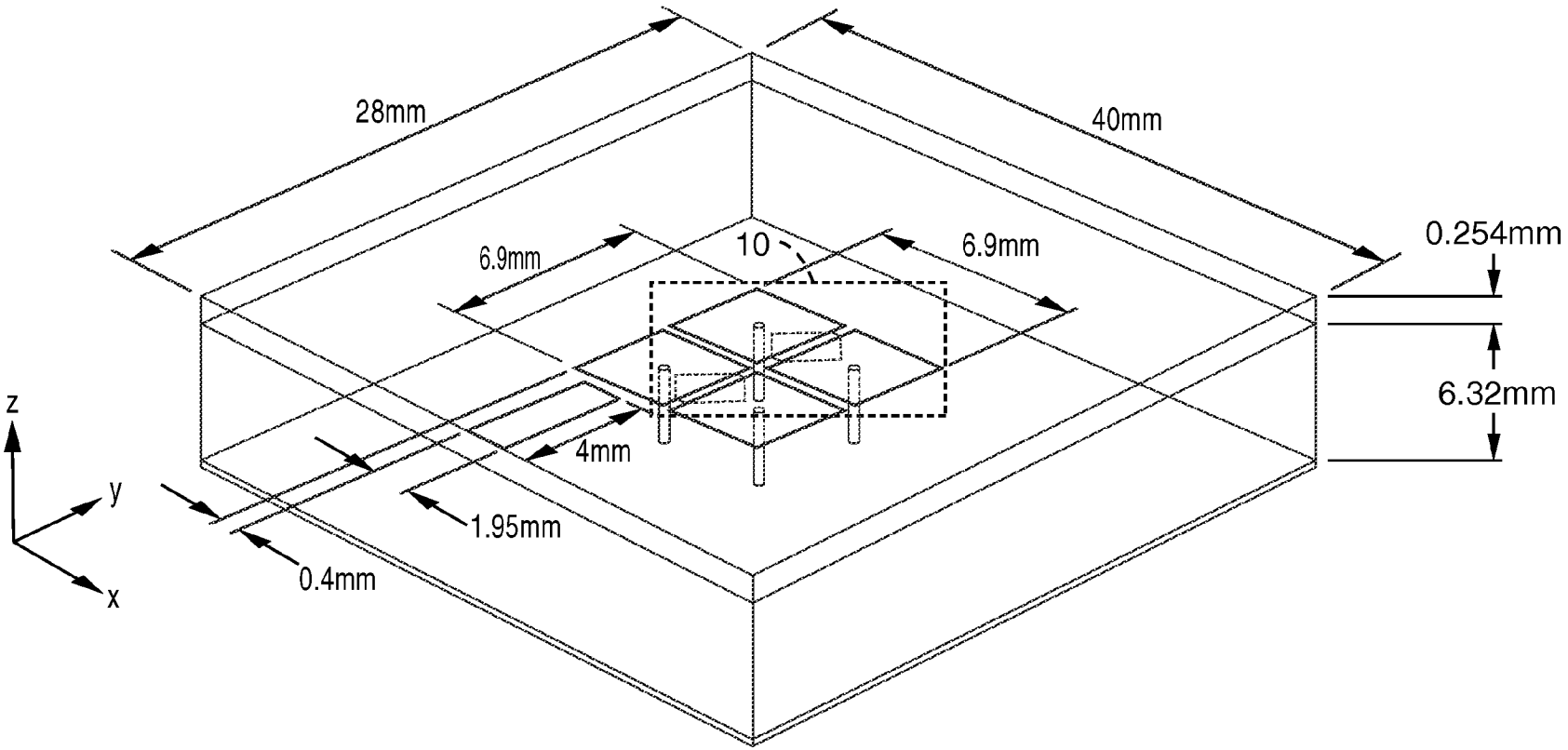
FIG. 9 is a schematic perspective view of an embodiment of the dual-band resonator structure shown in FIG. 1 with exemplary dimensions for operation in the 1.9 GHz and 2.4 GHz frequency bands.
Figure 10:
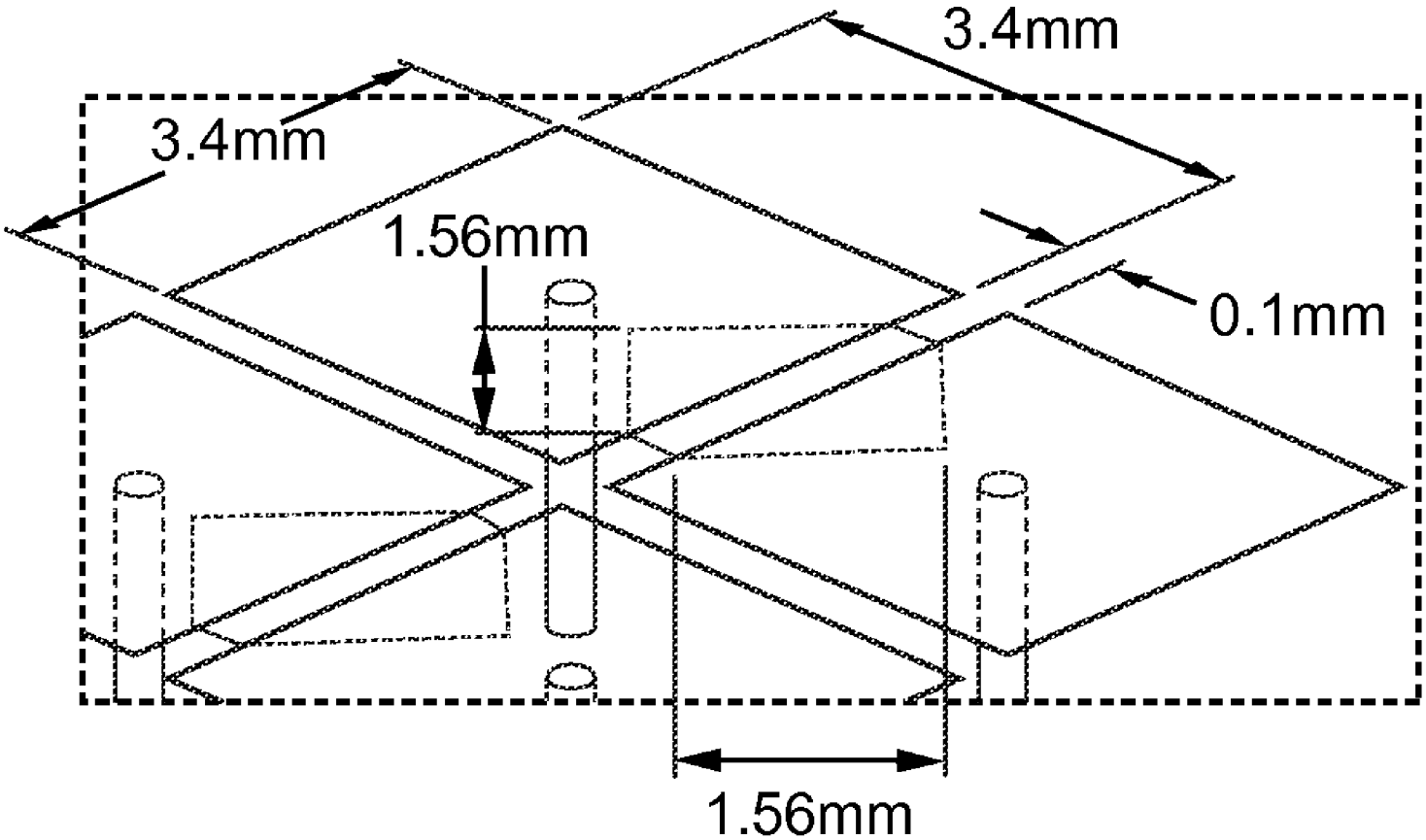
FIG. 10 is a detail view of a portion of the structure shown in FIG. 9, illustrating the patch and MIM capacitor dimensions.

A prototype compact dual-band antenna was fabricated using the design shown in FIG. 1 through FIG. 3 and FIG. 4 through FIG. 8 and the dimensions shown in FIG. 9 and FIG. 10 for operation generally at 1.9 GHz and 2.4 GHz in the x- and y-directions, respectively. RT/Duroid material was used for the substrate, and 0.8 mil thick copper was used for the patches. The thicknesses of the upper substrate layer was chosen so that its dielectric constant ∈ was much greater than that of the lower substrate layer, the dielectric constants of the upper and lower layers being approximately 10.0 and 2.2, respectively. The microstrip feedline was positioned in an offset feed configuration and coupled to the antenna by a 0.1 mm gap. The particular width of the microstrip feedline was chosen for impedance matching at 50-ohms.

As can be seen in the figures, the left edge of the feedline is offset from the left edge of the patch by 0.4 mm. This places the center of the feedline at 0.325 mm left of center the patch, and the right edge of the feedline at 1.05 mm left of the right edge of the patch (1.10 mm left of center of the array). This offset feed configuration enabled the excitation of two left-handed (LH) n=−1 modes along the x- and y-directions at the same time.

The x- and y-direction dispersion curves for the exemplary antenna are shown in FIG. 4. A full-wave simulation (HFSS) and the measured result of the antenna are compared in FIG. 11. As can be seen, the simulation and measured results show good agreement between each other. The measured return losses at 2.37 GHz and 1.96 GHz were −6.8 dB and −18.4 dB, respectively. The frequency peak that appears at the lower frequency is due to the mode coupling.

Figure 12A:
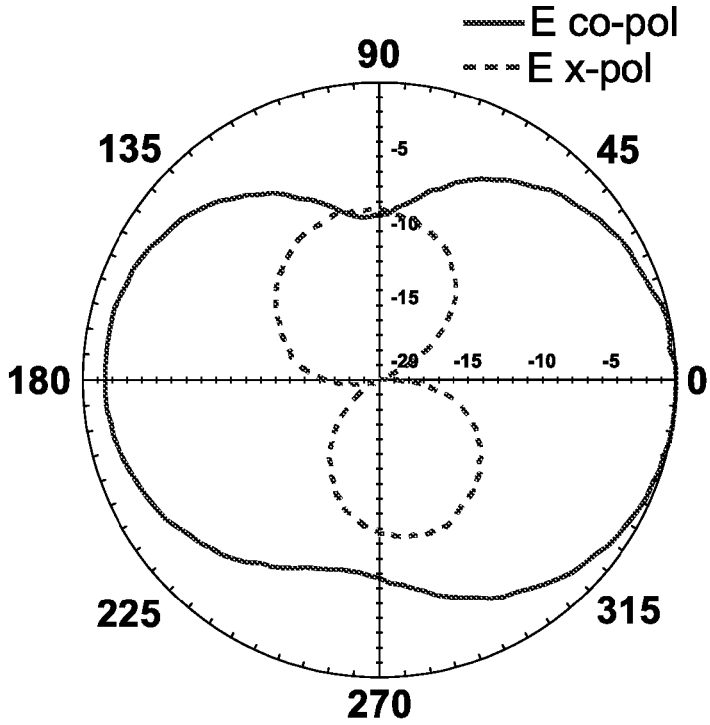
FIG. 12A and FIG. 12B are plots of the normalized radiation patter for the dual-band antenna embodiment shown in FIG. 9 and FIG. 10 at 1.96 GHz in the x-z or E-plane (FIG. 12A) and the y-z or H-plane (FIG. 12B).
Figure 12B:
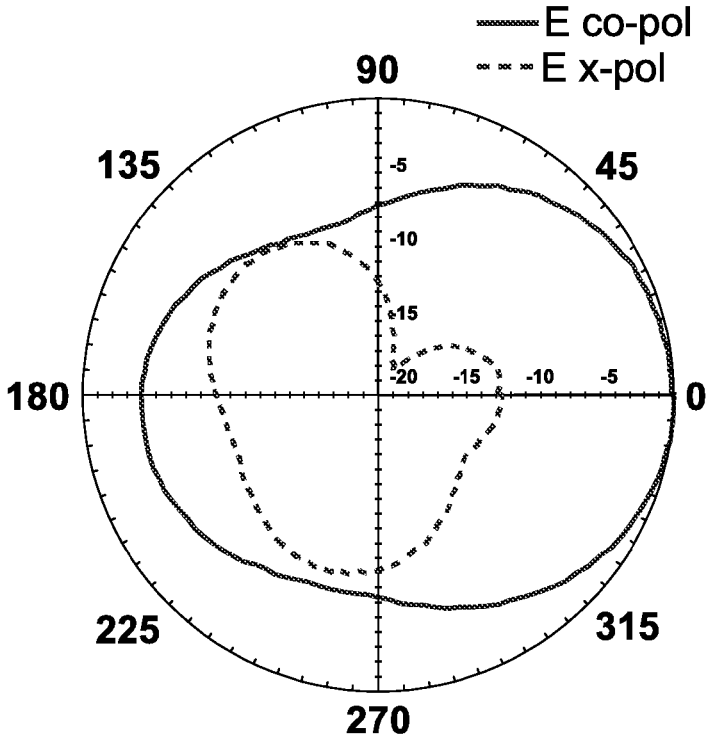
Figure 13A:
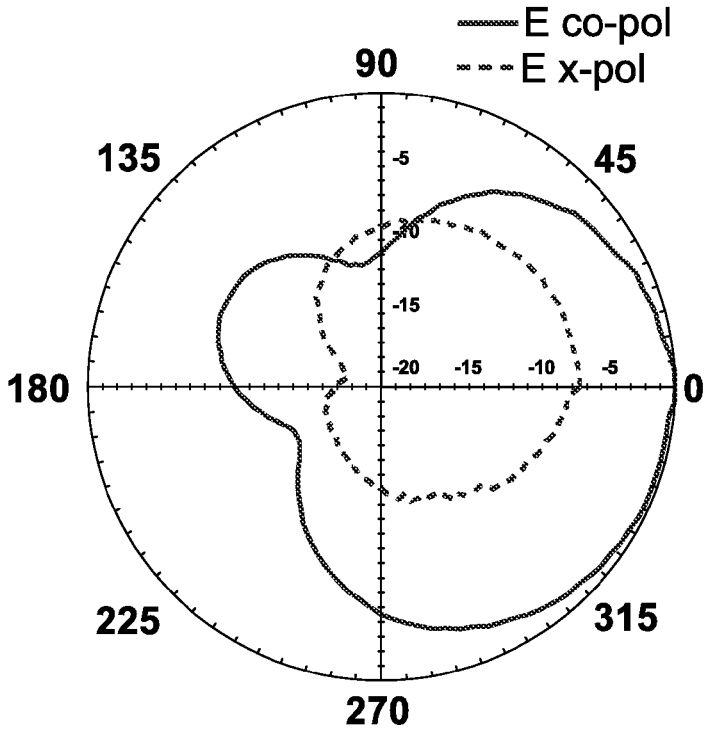
FIG. 13A and FIG. 13B are plots of the normalized radiation patter for the dual-band antenna embodiment shown in FIG. 9 and FIG. 10 at 2.37 GHz in the x-z or E-plane (FIG. 13A) and the y-z or H-plane (FIG. 13B).
Figure 13B:
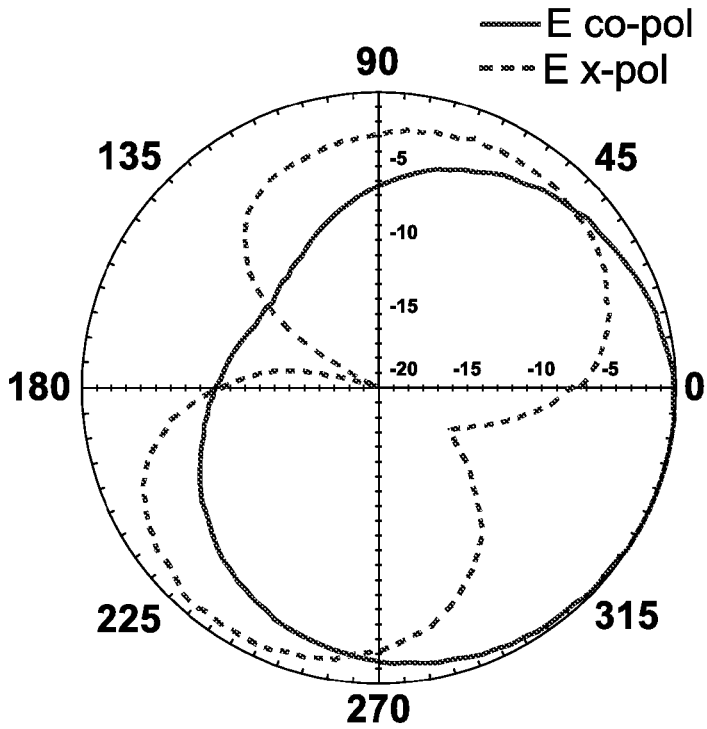

Radiation patterns for 1.96 GHz and 2.37 GHz were collected, and the normalized radiation patterns for those frequencies are shown in FIG. 12 and FIG. 13, respectively.

The E-plane and H-plane of the dual-band antenna resonant at 1.96 GHz were in the x-z and y-z planes. The E-plane and H-plane of the antenna resonant at 2.37 GHz were in the y-z and x-z planes, respectively. The measured antenna gains in the broadside direction for 1.96 GHz and 2.37 GHz were −3 dBi and −2.3 dBi, respectively. As shown in FIG. 12, the cross-polarizations were better than −14 dB at 1.96 GHz for both the E-plane and H-plane. These results indicate that the antenna has good linear polarization at this frequency. However, as shown in FIG. 13, the cross-polarization for the E-plane and H-plane at 2.36 GHz were more than −10 dB. This may be attributed to the smaller ground plane in the y-direction than in the x-direction.

Figure 11:
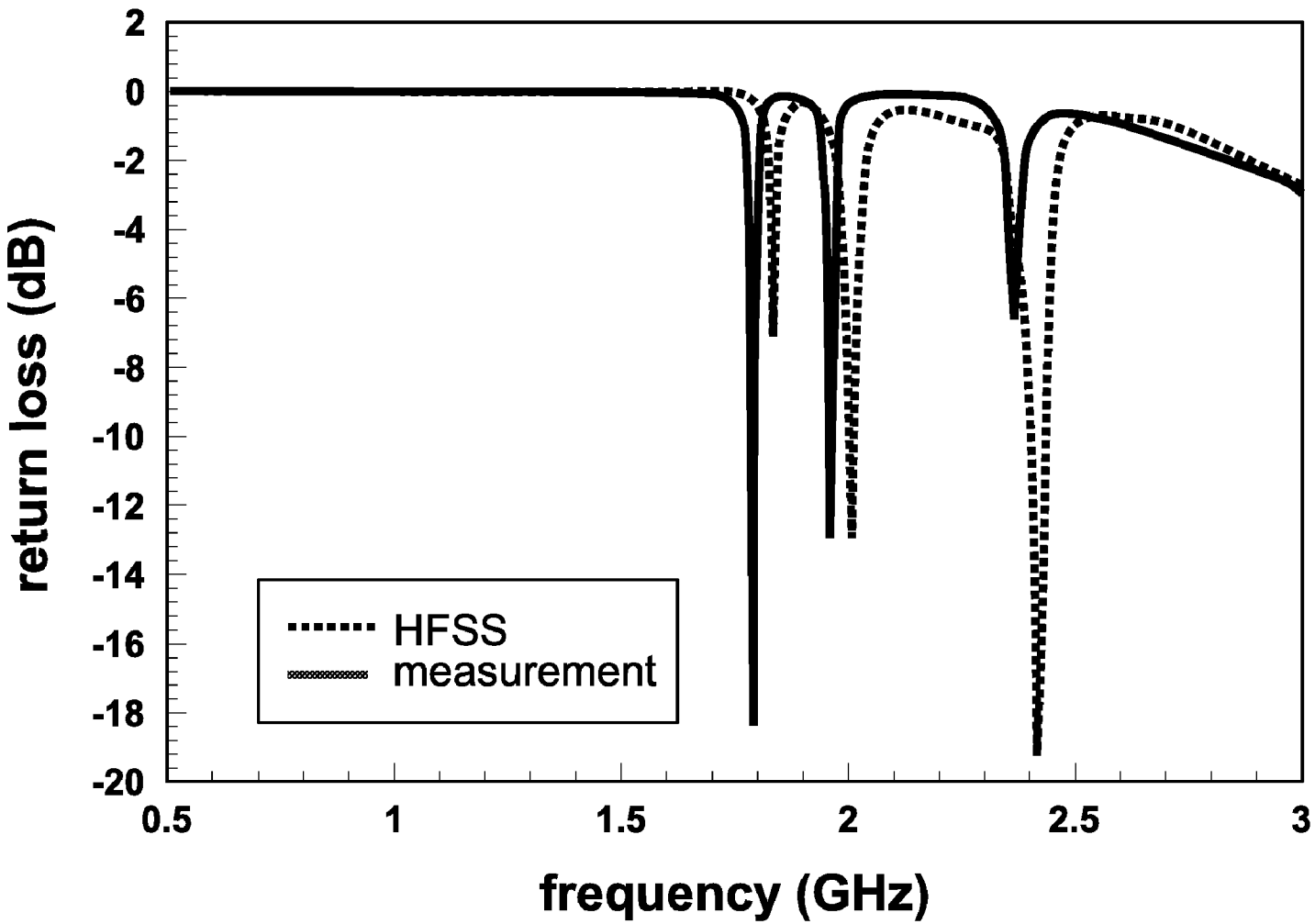
FIG. 11 is a graph showing simulated and measured return loss for the dual-band antenna embodiment shown in FIG. 9 and FIG. 10.

The method described in H. G. Schantz, "Radiation efficiency of UWB antennas," *IEEE Conference on Ultra Wideband Systems and Technologies*, pp. 351-355, May 2002, was used to estimate the radiation efficiency. The measured antenna radiation efficiency was 28.9% at 2.37 GHz and 25.4% at 1.96 GHz. The radiation efficiency at the lowest peak occurred at 1.79 GHz, as shown in FIG. 11, and was measured to be only 6.9%. This verifies that the occurrence of this mode is due to the mode coupling of the two orthogonal n=−1 modes. The more complicated field distribution of the coupling mode will reduce the radiation efficiency. The width, length and height of the dual-band antenna (i.e., 6.9 mm×6.9 mm×6.574 mm) in terms of free space wavelength at 2.37 GHz were $1/18\lambda_0$, $1/18\lambda_0$, and $1/19\lambda_0$, respectively. This indicates a 96% area reduction compared to a conventional patch antenna.

In alternative embodiments of the present invention, a two dimensional anisotropic cell structure can vary the patch sizes and feed locations along the x- and y-directions without relying on MIM capacitor location placements to precipitate the necessary asymmetry for the dual-band response. In other embodiments, MIM capacitance can be added in both the x- and y-directions, in different amounts, and still achieve compact dual-band resonant operation as described.

As previously discussed, embodiments of the present invention achieve dual-band operation very differently from conventional methods which strongly depend on the physical dimensions in the resonant directions. This is why the design parameters shown in FIG. 9 and FIG. 10 and described above are based on square-shaped CRLH unit cells and a 2×2 array of those unit cells having the same physical dimensions in both the x- and y-directions. It will be appreciated, however, that it is not necessary for x- and y-dimensions to be the same lengths in specific applications. For example, antenna gain can be controlled by aperture size; therefore, one dimension could be made slightly larger to compensate for the smaller gain at the other resonant frequency.

Furthermore, the feeding network need not contain only a single feed. A single, offset, feed line as described above is certainly the simplest way to excite two orthogonal modes. However, dual feeds may be desired in some applications, and the design above is clearly suitable for use with dual feeds.

Note also that, when square-shaped patches are used, four of them are configured in a two-by-two array with MIM capacitors bridging the patches along only the x-direction to produce the two different responses in the x- and y-directions. However, if rectangular patches were used instead, without bridging MIM capacitors, then the two different responses in the x- and y-directions will be available in as little as a one-by-one cell array. More complex geometries like ovals, triangles, hexagons, octagons, etc. are also possible.

It will also be appreciated from the discussion above that the device can be configured for operation at higher order modes (i.e., lower negative resonance). For example, to achieve a negative resonance lower than n=−1, the array size would be increased from 2×2 to 3×3 or larger. In other words, operation at n=−2, n=−3 and higher order modes with lower resonant frequencies would be achieved by using more CRLH unit cells cascaded together than would be used for operation at n=−1.

Figure 14:
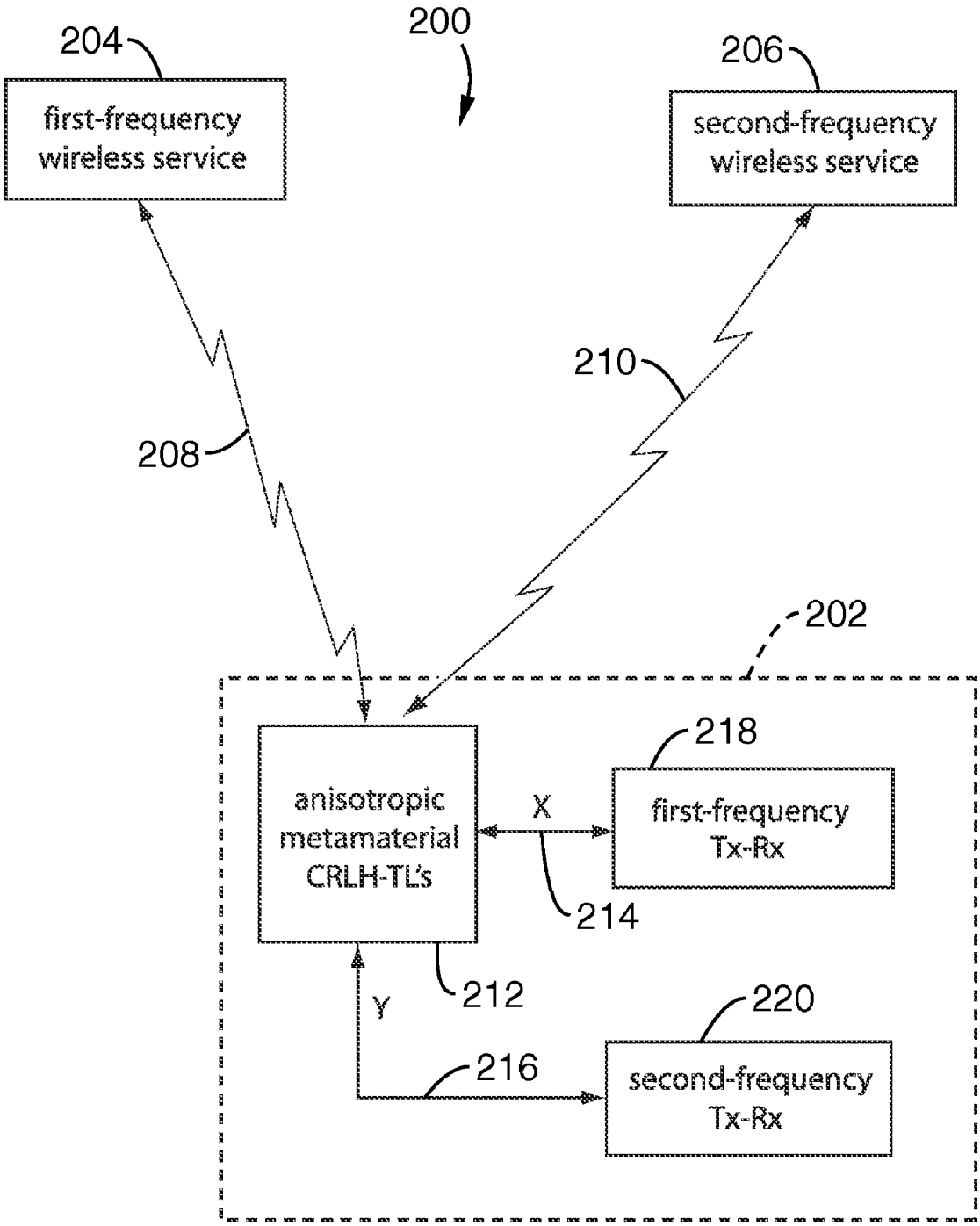
FIG. 14 is a functional block diagram of a portable wireless device with a micro-miniaturized dual-band antenna and two different frequency wireless services.

Referring now to FIG. 14, a system embodiment of the present invention is illustrated, and is referred to herein by the general reference numeral 200. System 200 includes a portable wireless device 202 supported by a first-frequency wireless service 204 and a second-frequency wireless service 206. Examples of such wireless services include, but are not limited to, G3-type GSM/PCS cellphone wireless WAN services, WiFi WLAN, and Bluetooth Radio carriers 208 and 210 are on two different frequencies and require device 202 to have a dual-band antenna 212. Here, the dual-band antenna 212 is constructed using an anisotropic metamaterial as described above. An x-direction feed 214 supports a first-frequency wireless transmitter/receiver, and a y-direction feed 216 supports a second-frequency wireless transmitter/receiver 220. The dual-band antenna 212 employ physically separate feeds in the x- and y-directions or, preferably, employ a single feed as previously described herein. In the case of a single input to the antenna, a duplexer or diplexer (not shown) would be used for combining or separating the two frequency bands.

It will be appreciated that, in using an anisotropic medium to realize multi-band operation, it is not necessary to operate only in orthogonal x- and y-directions. There can be more directions used in the x-y plane, or even in three dimensions, as long as different unit cell behavior can be realized in the corresponding directions. By manipulating the unit cell compositions in three directions, for example, a tri-band antenna could be implemented.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A dual-band anisotropic metamaterial resonant apparatus, comprising:

a plurality of spaced-apart microstrip composite right/left handed (CRLH) unit cells arranged in an array;

said array having first and second orthogonal directions;

at least two of said unit cells cascaded in the first direction; and at least two of said unit cells cascaded in the second direction;

said array having different β's in orthogonal propagation directions to achieve dual-band resonance.

2. An apparatus as recited in claim 1, wherein physical size of said array is the same in said first and second directions.

3. An apparatus as recited in claim 1, further comprising:

a microstrip feedline coupled to said array;

said feedline positioned off-center in relation to center of said array;

said feedline configured to excite said array in two modes along the first and second directions at the same time.

4. An apparatus as recited in claim 3, wherein said feedline is configured to excite the array in two LH modes.

5. An apparatus as recited in claim 1, wherein said array comprises a 2×2 array of CRLH unit cells.

6. An apparatus as recited in claim 1, further comprising:

a microstrip capacitor;

said microstrip capacitor positioned to increase capacitive coupling between at least two adjacent unit cells in said first direction but not between adjacent unit cells in said second direction.

7. An apparatus as recited in claim 6, wherein said microstrip capacitor comprises a metal-insulator-metal capacitor.

8. An apparatus as recited in claim 1, wherein said apparatus is a component of a wireless communications device.

9. An apparatus as recited in claim 8, wherein said component comprises an antenna.

10. An anisotropic metamaterial dual-band resonant apparatus, comprising:

a first dielectric substrate layer, said first substrate layer having a surface;

a metallized backplane layer;

a second dielectric substrate layer between said first substrate layer and said backplane layer; and a plurality of spaced-apart microstrip composite right/left handed (CRLH) unit cells formed of metallized patches arranged in an array on the surface of said first substrate layer, each said patch having an electrical connection to said backplane layer through said second substrate layer;

said array having first and second orthogonal directions;

at least two of said unit cells cascaded in the first direction;

at least two of said unit cells cascaded in the second direction;

said array having different β's in orthogonal propagation directions to achieve dual-band resonance.

11. An apparatus as recited in claim 10, wherein physical size of said array is the same in said first and second directions.

12. An apparatus as recited in claim 10, further comprising:

a microstrip feedline coupled to said array;

said feedline positioned off-center in relation to center of said array;

said feedline configured to excite said array in two modes along the first and second directions at the same time.

13. An apparatus as recited in claim 12, wherein said feedline is configured to excite the array in two LH modes.

14. An apparatus as recited in claim 10, wherein said array comprises a 2×2 array of CRLH unit cells.

15. An apparatus as recited in claim 10, further comprising:

a microstrip capacitor;

said capacitor positioned between said first and second substrate layers;

said capacitor overlapping at least two adjacent unit cells to provide additional capacitive coupling between said unit cells in said first direction but not between adjacent unit cells in said second direction.

16. An apparatus as recited in claim 15, wherein said microstrip capacitor comprises a metal-insulator-metal capacitor.

17. An apparatus as recited in claim 10, wherein said apparatus is a component of a wireless communications device.

18. An apparatus as recited in claim 17, wherein said component comprises an antenna.

19. A dual-band anisotropic metamaterial resonant apparatus, comprising:

a 2×2 array of spaced-apart microstrip unit cells;

said array having first and second orthogonal propagation directions;

said array having different β's in said orthogonal propagation directions to achieve dual-band resonance.

20. An apparatus as recited in claim 19, wherein physical size of said array is the same in said first and second directions.

21. An apparatus as recited in claim 19, further comprising:

a microstrip feedline coupled to said array;

said feedline positioned off-center in relation to center of said array;

said feedline configured to excite said array in two modes along the first and second propagation directions at the same time.

22. An apparatus as recited in claim 19, wherein said feedline is configured to excite the array in two n=−1 modes.

23. An apparatus as recited in claim 19, further comprising:

a first microstrip capacitor;

said first microstrip capacitor positioned to increase capacitive coupling between a first two of said unit cells in said first propagation direction but not between adjacent unit cells in said second propagation direction; and a second microstrip capacitor;

said second microstrip capacitor positioned to increase capacitive coupling between a second two of said unit cells in said first propagation direction but not between adjacent unit cells in said second propagation direction.

24. An apparatus as recited in claim 23, wherein said microstrip capacitors comprises a metal-insulator-metal capacitors.

25. An apparatus as recited in claim 19, wherein said apparatus is a component of a wireless communications device.

26. An apparatus as recited in claim 25, wherein said component comprises an antenna.

27. A micro-miniature dual-band resonant device, comprising:

an anisotropic metamaterial having at least two-dimensions in an x-y plane;

a pair of composite right/left handed transmission lines (CRLH-TL's) implemented within the same spaces of the anisotropic metamaterial but with different frequency responses in different directions within the anisotropic metamaterial; and a feed to the CRLH-TL's providing for a first frequency of operation and a second frequency of operation with respective ones of CRLH-TL's in said dual-band resonant device.

28. A device as recited in claim 27, further comprising:

an array of individual constituent periodic structures disposed in the anisotropic metamaterial that together implement the CRLH-TL's.

29. A device as recited in claim 28, further comprising:

a unit cell structure having a metal plate with a via connecting said metal plate at its center to an underlying backplane, and disposed within each of the individual constituent periodic structures, and having an equivalent circuit in which a T-bandpass circuit includes a shunt L-C circuit implemented by said via connection and underlying backplane, and series L-C circuits across each direction implemented by said metal plates and gaps them.

30. A device as recited in claim 29, further comprising:

a metal-insulator-metal (MIM) capacitor disposed between adjacent ones of the unit cells structures in one direction only, wherein such directional asymmetry imparts correspondingly different frequency responses to each of the CRLH-TL's.

31. A device as recited in claim 27, wherein said device is a component of a wireless communications device.

32. A device as recited in claim 31, wherein said component comprises an antenna.

33. A method of micro-miniaturization of a dual-band resonant device, comprising:

micro-miniaturizing said device by implementing it with composite right/left handed transmission lines (CRLH-TL's) each having different frequency responses; and imparting a multi-band functionality to said device by implementing a plurality of said CRLH-TL's to lie in different directions within an anisotropic metamaterial.

34. A method as recited in claim 33, further comprising:

constructing said anisotropic metamaterials and CRLH-TL's to use individual constituent periodic structures in a square array.

35. A method as recited in claim 34, further comprising:

placing metal-insulator-metal (MIM) capacitors between adjacent ones of individual constituent periodic structures in one of the x- and y-directions only, to impart an asymmetry that produces a frequency response difference between orthogonal ones of the CRLH-TL's and therein enables said dual-band functionality.

36. A method as recited in claim 34, wherein said device is a component of a wireless communications device.

37. A method as recited in claim 36, wherein said component comprises an antenna.

38. A portable wireless device, comprising:

a micro-miniature dual-band antenna for simultaneous operation at different first and second frequencies;

a first frequency wireless transmitter or receiver coupled to the antenna for interoperation with a first-frequency wireless service; and a second frequency wireless transmitter or receiver coupled to the antenna for interoperation with a second-frequency wireless service;

wherein all such components are completely disposed within a single said portable wireless device.

39. A portable wireless device of claim 38, wherein said antenna further comprises:

an anisotropic metamaterial having two-dimensions in the x- and y-directions;

a pair of composite right/left handed transmission lines (CRLH-TL's) implemented within the same spaces of the anisotropic metamaterial but with different frequency responses in the x- and y-directions of the anisotropic metamaterial;

a first feedline coupled to one of the CRLH-TL's in said x-direction providing for a first frequency of operation; and a second feedline to the other one of the CRLH-TL's in said y-direction providing for a second frequency of operation in said dual-band antenna;

wherein said first and second feedlines are separate feedlines or are the same feedlines.

40. A portable wireless device as recited in claim 39, further comprising:

an array of individual constituent periodic structures disposed in the anisotropic metamaterial that together implement the CRLH-TL's.

41. A portable wireless device as recited in claim 40, further comprising:

a unit cell structure having a metal plate with a via connecting said metal plate at its center to an underlying backplane, and disposed within each of the individual constituent periodic structures, and having an equivalent circuit in which a T-bandpass circuit includes a shunt L-C circuit implemented by said via stem connection and underlying backplane, and series L-C circuits across each x- and y-direction implemented by said square metal plates and gaps between them.

42. A portable wireless device as recited in claim 41, further comprising:

a metal-insulator-metal (MIM) capacitor disposed between adjacent ones of the unit cell structures in one of the x- and y-directions only, wherein such directional asymmetry imparts correspondingly different frequency responses to each of the pair of CRLH-TL's.

43. A portable wireless device, comprising:

a micro-miniature dual-band antenna for simultaneous operation at different first and second frequencies;

a first frequency wireless transmitter or receiver coupled to the antenna for interoperation with a first-frequency wireless service; and a second frequency wireless transmitter or receiver coupled to the antenna for interoperation with a second-frequency wireless service;

wherein said antenna further comprises:

an anisotropic metamaterial having two-dimensions in the x- and y-directions;

a pair of composite right/left handed transmission lines (CRLH-TL's) implemented within the same spaces of the anisotropic metamaterial but with different frequency responses in the x- and y-directions of the anisotropic metamaterial;

a first feedline coupled to one of the CRLH-TL's in said x-direction providing for a first frequency of operation;

a second feedline to the other one of the CRLH-TL's in said y-direction providing for a second frequency of operation in said dual-band antenna;

wherein said first and second feedlines are separate feedlines or are the same feedlines;

an array of individual constituent periodic structures disposed in the anisotropic metamaterial that together implement the CRLH-TL's;

a unit cell structure having a metal plate with a via connecting said metal plate at its center to an underlying backplane, and disposed within each of the individual constituent periodic structures, and having an equivalent circuit in which a T-bandpass circuit includes a shunt L-C circuit implemented by said via stem connection and underlying backplane, and series L-C circuits across each x- and y-direction implemented by said square metal plates and gaps between them; and a metal-insulator-metal (MIM) capacitor disposed between adjacent ones of the unit cell structures in one of the x- and y-directions only, wherein such directional asymmetry imparts correspondingly different frequency responses to each of the pair of CRLH-TL's;

wherein all such components are completely disposed within a single said portable wireless device.

* * * * *